US006708341B1

(12) United States Patent
Schaller

(10) Patent No.: US 6,708,341 B1
(45) Date of Patent: Mar. 23, 2004

(54) WOODCARVER'S APRON WITH LAP BASIN FOR RETAINING WASTE MATERIAL

(76) Inventor: Stephanie Schaller, 1709 Goose Creek Ct., Raymore, MO (US) 64083

( * ) Notice: Subject to any disclaimer, the term of this patent is extended or adjusted under 35 U.S.C. 154(b) by 0 days.

(21) Appl. No.: 10/376,403

(22) Filed: Feb. 28, 2003

(51) Int. Cl.[7] ..... A41D 13/04
(52) U.S. Cl. ..... 2/51; 2/48
(58) Field of Search ..... 2/51, 48, 49.1, 2/49.2, 49.3, 49.4, 255, 258, 46, 50, 52

(56) References Cited

U.S. PATENT DOCUMENTS

| | | | | | |
|---|---|---|---|---|---|
| 2,265,690 | A | * | 12/1941 | Fiedler | 2/48 |
| 2,672,614 | A | * | 3/1954 | Zimmerman et al. | 2/49.3 |
| 2,884,640 | A | * | 5/1959 | Liebowitz | 2/258 |
| 3,407,407 | A | * | 10/1968 | Hollander et al. | 2/49.2 |
| 3,686,692 | A | * | 8/1972 | Snare et al. | 2/258 |
| 4,114,199 | A | * | 9/1978 | Malan | 2/49.3 |
| 4,412,369 | A | * | 11/1983 | Carnaghi | 2/48 |
| 5,062,558 | A | * | 11/1991 | Stang | 2/49.2 |
| 5,107,545 | A | * | 4/1992 | Potter | 2/48 |
| 5,285,940 | A | * | 2/1994 | Goulter | 2/49.2 |
| 6,308,333 | B1 | * | 10/2001 | Jackson | 2/49.4 |
| 6,405,374 | B1 | * | 6/2002 | Giakas-Cano | 2/52 |
| 2002/0004945 | A1 | * | 1/2002 | Kaloustian | 2/49.1 |

FOREIGN PATENT DOCUMENTS

| | | | | |
|---|---|---|---|---|
| GB | 1008 | * | of 1886 | 2/49.2 |
| GB | 2178298 | * | 2/1987 | 2/49.2 |

* cited by examiner

*Primary Examiner*—A. Vanatta
(74) *Attorney, Agent, or Firm*—Shook, Hardy & Bacon LLP

(57) ABSTRACT

The present invention generally relates to an apron having a lap basin that is bounded by a stiffened rim which acts as a waste retaining barrier. In one embodiment, the present invention includes a lap basin that is attached to the bottom edge of a torso section. The lap basin includes a stiffened rim and a bottom section with the stiffened rim attached to the outside edge of the bottom section so that it is positioned in a generally vertical manner. The stiffened rim is constructed by inserting a relatively stiff material, such as a polyester film, into a rim tube. The torso section includes a head loop that is attached to the top edge of a bib and two tie straps that are attached to the top of the vertical side edges of the bib. The elements that form the torso section and the bottom section and rim tube of the lap basin are constructed from a flexible, durable fabric which causes the apron to comfortably conform to a user's shape and position. When a user wearing the apron assumes a sitting position, the lap basin provides a broad, open working area that will retain waste material such as carving chips or shavings.

9 Claims, 1 Drawing Sheet

WOODCARVER'S APRON WITH LAP BASIN FOR RETAINING WASTE MATERIAL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to an apron. More particularly, the present invention is directed to an apron that includes a flexible work area bounded by a waste retaining barrier.

Many crafts may be more comfortably performed while a person is sitting on a chair or couch. For example, whittlers and chip carvers often find that practicing their carving while sitting allows their arms to bend at the elbow and extend into their lap. This position is more comfortable, convenient and ergonomic than carving while standing or perching on a stool. Unfortunately, the practice of many crafts produces a steady amount of waste material which is both messy and potentially dangerous. For this reason, many people that practice crafts wear an apron or other protective garment to shield themselves. However, if a person is working while sitting down, instead of working at a table or work bench for example, then the waste material may fall to the floor or to the chair where the person is sitting. Standard aprons do nothing to prevent this situation.

At least one manufacturer has attempted to provide an apron that is suitable to wear while working at a craft in a sitting position and that provides a means to catch and/or contain the waste material produced. Generally, these aprons include a pouch or pocket for catching and collecting wood chips and the like. However, the pouches on these aprons were not designed with sitting anywhere other than on a stool in mind. More specifically, the pouches are attached to the front portion of the apron. If the person is perched on a stool, the pouch is aligned in a generally vertical manner so that waste material might fall into the pouch. However, if the person is in a sitting position, that is the person's thighs are perpendicular to their torso, such as when a person sits on a chair or couch, the pouch is aligned generally horizontally. In addition, the mouth or opening of the pouch usually will close when a person sits down unless an additional piece or prop is inserted into the opening. Needless to say, it is difficult to direct wood chips, shavings or other waste into such a pouch when a person is sitting in a chair or on a couch without unnecessary inconvenience.

Therefore, it is desirable to provide an apron that is specifically designed to include a flexible, convenient, and effective work area bounded by a waste retaining barrier when the wearer is in a sitting position. It is further desirable to provide such an apron that is durable and light-weight and that may be washed without losing its effectiveness.

SUMMARY OF THE INVENTION

The present invention generally relates to an apron having a lap basin that is bounded by a stiffened rim which acts as a waste retaining barrier. In one embodiment, the present invention includes a lap basin that is attached to the bottom edge of a torso section. The lap basin includes a stiffened rim and a bottom section with the stiffened rim attached to the outside edge of the bottom section so that it is positioned in a generally vertical manner. The stiffened rim is constructed by inserting a relatively stiff material, such as a polyester film, into a rim tube. The torso section includes a head loop that is attached to the top edge of a bib and two tie straps that are attached to the top of the vertical side edges of the bib. The elements that form the torso section and the bottom section and rim tube of the lap basin are constructed from a flexible, durable fabric which causes the apron to comfortably conform to a user's shape and position. When a user wearing the apron assumes a sitting position, the lap basin provides a broad, open working area that will retain waste material such as carving chips or shavings.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figures 1, 2, 3, 4:
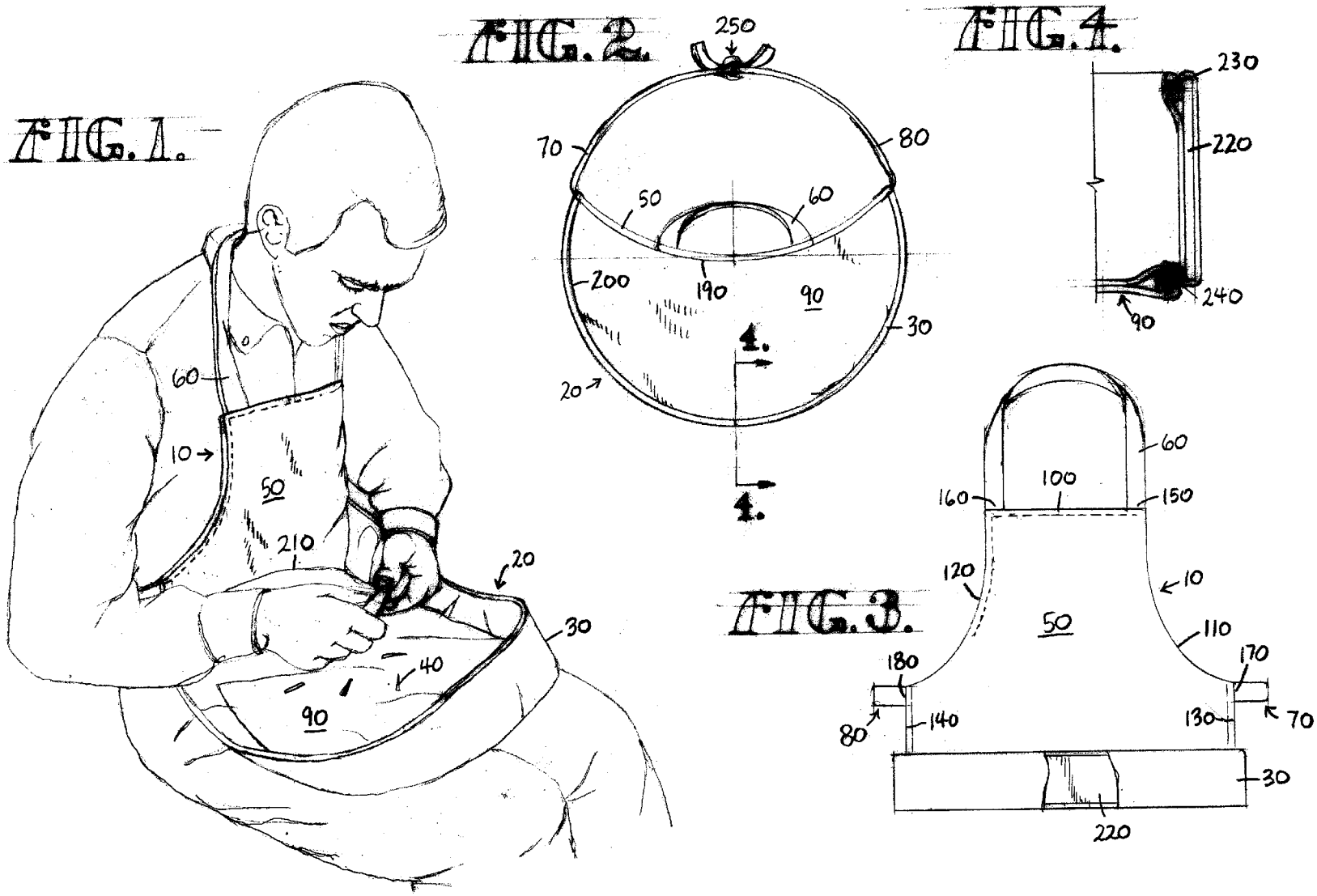
FIG. 1 is a perspective view of one embodiment of the present invention being worn by a user in a sitting position.
FIG. 2 is a top view of the invention shown in FIG. 1 without the user.
FIG. 3 is a front elevational view of the invention shown in FIG. 1 without the user and with a portion of the rim tube broken away to show the stiffener inserted into the rim tube.
FIG. 4 is a side sectional view taken along line 4—4 in FIG. 2 showing the stiffening rim and the bottom portion of the lap basin.

The present invention provides an apron that allows a user to sit comfortably while working at a craft, such as carving, without worrying that waste material will spill about the user's work area. Referring first to FIG. 1, the apron includes a torso section 10 and a lap basin 20 having a stiffened rim 30 that acts to retain waste material 40 within lap basin 20. Torso section 10 includes a bib portion 50 and a head loop 60. As shown more clearly in FIGS. 2 & 3, torso section 10 also includes a first tie strap 70 and a second tie strap 80. Lap basin 20 includes a bottom portion 90 and a stiffened rim 30. Torso section 10 and lap basin 20 may be constructed from any durable, flexible fabric such as denim, canvas, oil cloth, leather, heavy cotton, nylon or vinyl. Also, head loop and tie straps may be formed from pre-finished webbing, heavy grosgrain ribbon or other suitable material.

As seen in FIG. 3, bib portion 50 of torso section 10 has a top edge 100, two curved side edges 110 and 120, two vertical side edges 130 and 140, and a bottom edge (not shown). Head loop 60 has a first end 150 and a second end 160 that are attached to top edge 100 of bib portion 50 to provide a closed loop. Tie straps 70 and 80 also have a first end 170 and 180 respectively and a second end (not shown). First end 170 of tie strap 70 is attached to the top of vertical side edge 130. Similarly, first end 180 of tie strap 80 is attached to the top of vertical side edge 140. It should be understood that head loop 60 may be formed from two pieces similar to first tie strap 70 and second tie strap 80. Also, it should be understood that first tie strap 70 and second tie strap 80 may be replaced by single adjustable strap.

As seen in FIG. 2, bottom portion 90 of lap basin 20 has a curved inside edge 190 and a curved outside edge 200.

Preferably, inside edge 190 has a radius and length that approximates the radius of the user's waist. This feature allows the apron to fit comfortably and naturally against the user when the user is in a sitting position. The bottom edge of bib 50 is attached to inside edge 190 of bottom section 90 to form a seam 210 (shown in FIG. 1). Thus, it should be understood that the length of the bottom edge of bib 50 and inside edge 190 of bottom portion 90 are equal and long enough that seam 210 extends past the hips of the user.

Stiffened rim 30 is attached to outside edge 200 of bottom portion 90. As shown in FIGS. 3 and 4, stiffened rim 30 includes a stiffener 220 inserted inside a rim tube 230. Preferably, stiffener 220 is formed from a polyester film, such as Mylar™, that has a thickness of between ten and twenty millimeters. For example, in one preferred embodiment, approximately 15 millimeters of Mylar™ was used to form stiffener 220. In addition to being only relatively rigid and light-weight, polyester film provides the advantages of being both water-proof and crush-resistant which allows the user to wash the apron without causing the rim to lose its stiffness. Additional material, such as various plastics, paperboard, or corrugated cardboard, are also suitable and included within the scope of this invention. When polyester film is used, the height of stiffened rim 30 preferably is three to four inches. This height ensures that rim 30 does not sag and allows the user's arms to fall naturally towards his or her lap without interference.

To produce the present invention, head loop 60, tie straps 70 and 80, bib portion 50, rim tube 230 and bottom portion 90 are cut from a durable, flexible fabric. Preferably, these elements are constructed from two identical pieces of fabric to improve their durability and the apron's aesthetic appearance, so for each element two pieces of fabric are cut. It should be understood that the pieces may be cut from different fabrics. Head loop 60, tie straps 70 and 80 and rim tube 230 have a generally rectangular shape, while bottom portion 90 and bib portion 50 have the shapes shown in FIGS. 2 and 3 respectively. Stiffener 220, which is also rectangular, is cut from a stiff material so that its length is equal to outside edge 200 of bottom portion 90 of lap basin 20 and, preferably, its width is equal to between three and four inches.

Next, the ends 150 and 160 of head loop 60 are sewn onto top edge 100 of bib portion 50, and the first ends 170 and 180 of tie straps 70 and 80 are sewn onto the top of vertical side edges 130 and 140 respectively. Thereafter, the bottom edge of bib portion 50 is sewn to inside edge 190 of bottom portion 90 to form seam 210. It should be appreciated that since bib portion 50 and bottom portion 90 preferably are each formed by layering two pieces of similarly shaped fabric, that a single layer of bib portion 50 and a single layer of bottom portion 90 are sewn together before the remaining layers are sewn to their respective mates so that the seams are completely enclosed inside the apron.

To construct stiffened rim 30, rim tube 230 is formed first. In the preferred method, rim tube 230 is made by sewing together two pieces of fabric as shown in FIG. 4 so that a longitudinal cavity is formed. This method of sewing rim tube 230 has the advantage of providing seams that give additional support to stiffener 220. Thereafter, stiffener 220 is inserted into one end of the cavity and advanced throughout its length. Finally, rim tube 230 is sewn to bottom portion 90. As shown in FIG. 4, if bottom portion 90 is constructed of two pieces of fabric, then the bottom end 240 of rim tube 230 is sewn between the two pieces of fabric that make up bottom section 90.

To use, a person first inserts his or her head into and through the loop formed by head loop 60. Next, as shown in FIG. 2, the person ties first tie strap 70 and second tie strap 80 together in a releasable knot 250. Thereafter, as shown in FIG. 1, when the person assumes a sitting position, lap basin 20 is positioned naturally in the lap of the person and provides a working area that will retain waste material such as carving chips or shavings.

It will be appreciated by persons skilled in the art that the present invention is not limited to what has been particularly shown and described hereinabove. Rather, all matter shown in the accompanying drawings or described hereinabove is to be interpreted as illustrative and not limiting. Accordingly, the scope of the present invention is defined by the appended claims rather than the foregoing description.

What is claimed is:

1. An apron suitable for a person to wear while practicing a craft that produces waste material, said apron comprising:

a torso section that includes a bib portion, a head loop, and at least one tie strap, said bib portion including a top edge that extends generally horizontally, two side edges, and a bottom edge that extends generally horizontally, said two side edges each having a curved portion and a straight portion that extends generally vertically; and a lap basin that includes a bottom portion and a stiffened rim, said bottom portion having a first curved edge that is coupled to said bottom edge of said bib portion and a second curved edge that defines the outer periphery of said bottom portion, said stiffened rim including a stiffening material enclosed within a rim tube, said rim tube coupled to said second curved edge of said bottom portion, said stiffening material constructed from polyester film;

wherein when said person is in a sitting position, said lap basin is positioned in said person's lap to form a work area with said stiffened rim positioned generally vertically and acting to retain said waste material.

2. The apron of claim 1 wherein said bib portion, said head loop, said at least one tie strap, said bottom portion and said rim tube are formed from a material selected from the group consisting of denim, canvas, oil cloth, leather, heavy cotton, nylon or vinyl.

3. The apron of claim 1 wherein said bib portion, said head loop, said at least one tie strap, said bottom portion and said rim tube are each formed by sewing together two similarly shaped pieces of material.

4. The apron of claim 1 wherein said head loop and said at least one tie strap are formed from a material selected from the group consisting of pre-finished webbing or heavy grosgrain ribbon.

5. The apron of claim 1 wherein said head loop is attached to said top edge of said bib portion and said at least one tie strap is attached to said vertical side edges.

6. The apron of claim 1 wherein said polyester film is about 10 millimeters thick.

7. The apron of claim 1 wherein the thickness of said polyester film is between 10 millimeters and 20 millimeters.

8. The apron of claim 1 wherein said stiffening rim extends about 3 inches generally vertically from said bottom portion of said lap basin.

9. The apron of claim 1 wherein said stiffening rim extends between 3 inches to 4 inches generally vertically from said bottom portion of said lap basin.

* * * * *